US008557065B2

(12) United States Patent
Tada et al.

(10) Patent No.: US 8,557,065 B2
(45) Date of Patent: Oct. 15, 2013

(54) STEEL SHEET FOR CANS AND METHOD FOR MANUFACTURING THE SAME

(75) Inventors: Masaki Tada, Fukuyama (JP); Takumi Tanaka, Fukuyama (JP); Katsumi Kojima, Fukuyama (JP); Hiroki Iwasa, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/513,113

(22) PCT Filed: Nov. 29, 2010

(86) PCT No.: PCT/JP2010/071768

§ 371 (c)(1), (2), (4) Date: Aug. 6, 2012

(87) PCT Pub. No.: WO2011/068231

PCT Pub. Date: Jun. 9, 2011

(65) Prior Publication Data

US 2013/0045128 A1 Feb. 21, 2013

(30) Foreign Application Priority Data

Dec. 2, 2009 (JP) ..... 2009-274343

(51) Int. Cl.
*C21D 8/04* (2006.01)

(52) U.S. Cl.
USPC ..... 148/603; 148/541; 148/557; 148/584; 148/602; 420/128; 72/199

(58) Field of Classification Search
USPC ..... 148/603
See application file for complete search history.

(56) References Cited

U.S. PATENT DOCUMENTS

| | | | | |
|---|---|---|---|---|
| 5,108,518 | A * | 4/1992 | Fukui et al. | 148/603 |
| 6,063,214 | A * | 5/2000 | Fujinaga et al. | 148/602 |
| 6,221,180 | B1 * | 4/2001 | Tosaka et al. | 148/320 |

FOREIGN PATENT DOCUMENTS

| | | | | |
|---|---|---|---|---|
| JP | 62-096618 | A | | 5/1987 |
| JP | 63-007336 | A | | 1/1988 |
| JP | 03056644 | A | * | 3/1991 |
| JP | 2004-323905 | A | | 11/2004 |
| JP | 2006-009069 | A | | 1/2006 |
| JP | 2007-177315 | A | | 7/2007 |
| JP | 2007197742 | A | * | 8/2007 |
| JP | 2009-263788 | A | | 11/2009 |
| JP | 2009-263789 | A | | 11/2009 |
| JP | 2011-001609 | A | | 1/2011 |
| WO | WO 2009/116680 | A1 | | 9/2009 |

OTHER PUBLICATIONS

International Search Report dated Feb. 22, 2011, application No. PCT/JP2010/071768.

International Search Report dated Jun. 19, 2013, application No. EP 10 83 4679.

* cited by examiner

*Primary Examiner* — Roy King

*Assistant Examiner* — Christopher Kessler

(74) *Attorney, Agent, or Firm* — RatnerPrestia

(57) ABSTRACT

A high-strength, high-workability steel sheet for cans contains 0.070% to less than 0.080% C, 0.003% to 0.10% Si, 0.51% to 0.60% Mn, and the like on a mass basis and has a tensile strength of 500 MPa or more and a yield elongation of 10% or more. The average size and elongation rate of crystal grains are 5 μm or more and 2.0 or less, respectively, in cross section in the rolling direction thereof. The hardness difference obtained by subtracting the average Vickers hardness of a cross section ranging from a surface to a depth equal to one-eighth of the thickness of the sheet from the average Vickers hardness of a cross section ranging from a depth equal to three-eighths of the sheet thickness to a depth equal to four-eighths of the sheet thickness is 10 points or more and/or the maximum Vickers hardness difference is 20 points or more.

7 Claims, No Drawings

STEEL SHEET FOR CANS AND METHOD FOR MANUFACTURING THE SAME

CROSS REFERENCE TO RELATED APPLICATIONS

This application is the U.S. National Phase application of PCT International Application No. PCT/JP2010/071768, filed Nov. 29, 2010, and claims priority to Japanese Patent Application No. 2009-274343, filed Dec. 2, 2009, the disclosure of both are incorporated herein by reference in their entireties for all purposes.

FIELD OF THE INVENTION

The present invention relates to a steel sheet for cans having high strength and workability and a method for manufacturing the same.

BACKGROUND OF THE INVENTION

Among steel sheets used for beverage cans and food cans, steel sheets which are referred to as DR (Double Reduce) materials are used for lids, bottoms, three-piece can bodies, and drawn cans in some cases. The DR materials, which are cold-rolled (secondarily cold-rolled) again subsequently to annealing, are more readily reduced in thickness as compared with SR (Single Reduce) materials which are subjected only to a temper rolling with a small rolling reduction subsequently to annealing. The use of thin steel sheets allows can-making costs to be reduced.

The DR materials are work-hardened by cold rolling subsequent to annealing and therefore are thin hard steel sheets. However, the DR materials have low ductility and therefore are inferior in workability to the SR materials.

EOEs (Easy Open Ends) are widely used as lids for beverage cans and food cans.

In the course of manufacturing the EOEs, rivets for fixing tabs need to be formed by stretching and drawing. The ductility of a material that is required for such working corresponds to an elongation of about 10% as determined by a tensile test.

Body materials for three-piece cans are formed into a cylindrical shape and both ends thereof are then flanged for the purpose of swaging lids or bottoms. Therefore, end portions of can bodies also preferably have an elongation of about 10%.

On the other hand, steel sheets used as materials for making cans preferably have sufficient strength corresponding to the thickness thereof. In the case of the DR materials, which are thin, the DR materials preferably have a tensile strength of about 500 MPa or more for the purpose of ensuring the strength of cans.

It is difficult for the DR materials, which have been conventionally used, to achieve both the above ductility and strength. Therefore, the SR materials have been used for EOEs and body materials for beverage cans. However, in view of cost reduction, the use of the DR materials for such EOEs and body materials for beverage cans is increasingly preferred at present. Further, the materials can be used as materials for steel sheets for bodies of two-piece cans, DI (Drawn and Ironed) cans, DRD (Draw-Redraw) cans, aerosol cans, bottom ends, and the like.

In view of these circumstances, patent document 1 discloses a method for manufacturing a steel sheet having a high Lankford value and excellent flangeability by manufacturing a DR material from a low-carbon steel at a primary cold rolling reduction of 850 or less.

Patent document 2 discloses a method for manufacturing a DR material having a good balance between hardness and workability by treating low-carbon steel with nitrogen in an annealing step.

Patent document 3 discloses a method for manufacturing a lid for easy-open cans by scoring a thin steel sheet with a thickness of less than 0.21 mm such that the ratio of the residual score thickness to the thickness of the steel sheet is 0.4 or less, the steel sheet being obtained in such a manner that a steel slab containing 0.01% to 0.08% C, 0.05% to 0.50% Mn, and 0.01% to 0.15% Al is hot-rolled at a finish temperature not lower than the $Ar_3$ transformation temperature, is then cold-rolled, is then recrystallization-annealed by continuous annealing, and is then skin-passed at a rolling reduction of 5% to 10%.

Patent document 4 discloses a continuously annealed DR steel sheet for welded cans and also discloses a method for manufacturing the same. The steel sheet has excellent flangeability equaling or exceeding that of batch-annealed DR steel sheets in case that the steel sheet contains 0.04% to 0.08% C, 0.03% or less Si, 0.05% to 0.50% Mn, 0.02% or less P, 0.02% or less S, 0.02% to 0.10% Al, and 0.008% to 0.015% N, the amount of (N total−N as AlN) in the steel sheet being 0.007% or more, and the steel sheet satisfies the relations $X \geq 10\%$ and $Y \geq -0.05X+1.4$, where X is the value of total elongation of the steel sheet in the rolling direction thereof and Y is the value of average elongation thereof.

[Patent document 1] Japanese Unexamined Patent Application Publication No. 63-7336

[Patent document 2] Japanese Unexamined Patent Application Publication No. 2004-323905

[Patent document 3] Japanese Unexamined Patent Application Publication No. 62-96618

[Patent document 4] Japanese Unexamined Patent Application Publication No. 2007-177315

SUMMARY OF THE INVENTION

All the above conventional techniques, however, have problems described below.

In the manufacturing method disclosed in Patent document 1, the primary cold rolling reduction needs to be small; hence, an extremely thin steel sheet cannot be manufactured because of a limitation in finish thickness in hot rolling. A reduction in finish thickness in hot rolling causes a decrease in finish rolling temperature and therefore it is difficult to keep a predetermined temperature.

In the manufacturing method disclosed in patent document 2, after recrystallization is finished, nitriding treatment needs to be performed; hence, cost increases due to a reduction in line speed, an increase in furnace length, and the like cannot be avoided even in the case of performing nitriding treatment in a continuous annealing step.

In the manufacturing methods disclosed in patent documents 3 and 4, the content of Mn is kept low at 0.05% to 0.50% by weight. Therefore, these methods cannot cope with an increase in strength for the purpose of ensuring the compressive strength against a reduction in thickness.

Aspects of the present invention have been made in view of the above circumstances and provide a steel sheet for cans having high strength and workability and a method for manufacturing the same. The steel sheet is applicable to lids, bottoms, three-piece can bodies, two-piece can bodies, DI cans, DRD cans, aerosol cans, and bottom ends and is a material particularly suitable for EOEs.

The inventors have made intensive studies to solve the above problems and have obtained findings below.

In order to ensure the ductility of a high-strength material, strength is imparted to the material by adding an appropriate amount of C thereto, strain is induced in a surface layer of the material by increasing the rolling reduction of a final stand for primary cold rolling, then ferrite grains in the surface layer are coarsened by annealing, the concentration of ammonia in an annealing atmosphere is limited to less than 0.020% by volume so as to suppress nitrization of the surface layer, the secondary cold rolling reduction is limited within an appropriate range, and the surface layer of the steel sheet is softened. This allows the strength and ductility to be well balanced.

When the coiling temperature after hot rolling is high, precipitated cementite is coarsened and the local elongation is reduced. Therefore, the coiling temperature is preferably limited within an appropriate range.

Aspects of the present invention have been accomplished on the basis of the above findings and the summary thereof is as described below.

According to a first aspect, the invention provides a high-strength, high-workability steel sheet for cans containing 0.070% to less than 0.080% C, 0.003% to 0.10% Si, 0.51% to 0.60% Mn, 0.001% to 0.100% P, 0.001% to 0.020% S, 0.005% to 0.100% Al, and 0.010% or less N on a mass basis, the remainder being Fe and unavoidable impurities, the sheet having a tensile strength of 500 MPa or more and a yield elongation of 10% or more. The average size and elongation rate of crystal grains are 5 μm or more and 2.0 or less, respectively, in cross section in the rolling direction thereof. The hardness difference obtained by subtracting the average Vickers hardness of a cross section ranging from a surface to a depth equal to one-eighth of the thickness of the sheet from the average Vickers hardness of a cross section ranging from a depth equal to three-eighths of the sheet thickness to a depth equal to four-eighths of the sheet thickness is 10 points or more, and/or the hardness difference obtained by subtracting the maximum Vickers hardness of the cross section ranging from the surface to a depth equal to one-eighth of the sheet thickness from the maximum Vickers hardness of the cross section ranging from a depth equal to three-eighths of the sheet thickness to a depth equal to four-eighths of the sheet thickness is 20 points or more.

According to a second aspect, the invention is that in the high-strength, high-workability steel sheet for cans specified in the first aspect of the invention, in relation to the crystal grain size, the average crystal grain size difference obtained by subtracting the average size of crystal grains present between a depth equal to three-eighths of the sheet thickness to a depth equal to four-eighths of the sheet thickness from the average size of crystal grains present between the surface and a depth equal to one-eighth of the sheet thickness is 1 μm or more.

According to a third aspect, the invention is that in the high-strength, high-workability steel sheet for cans specified in the first or second aspects of the invention, in relation to the content of nitrogen, the average N content difference obtained by subtracting the average N content between the surface and a depth equal to one-eighth of the sheet thickness from the average N content between a depth equal to three-eighths of the sheet thickness to a depth equal to four-eighths of the sheet thickness is 10 ppm or more.

According to a fourth aspect, the invention is that in the high-strength, high-workability steel sheet for cans specified in any one of the first to third aspects of the invention, in relation to nitrides with a diameter of 0.02 μm to 1 μl, the average number density of the nitrides present between the surface and a depth equal to one-fourth of the sheet thickness is greater than the average number density of the nitrides present between the surface and a depth equal to one-eighth of the sheet thickness.

According to a fifth aspect, the invention is that in the high-strength, high-workability steel sheet for cans specified in any one of the first to fourth aspects of the invention, in relation to nitrides with a diameter of 0.02 μm to 1 μm, the quotient obtained by dividing the average number density of the nitrides present between the surface and a depth equal to one-twentieth of the sheet thickness by the average number density of the nitrides present between the surface and a depth equal to one-fourth of the sheet thickness is less than 1.5.

According to a sixth aspect, the invention is that in the high-strength, high-workability steel sheet for cans specified in any one of the first to fifth aspects of the invention, in relation to the content of carbon, a content of solute C in steel is 51 ppm or more.

According to a seventh aspect, the invention provides a method for manufacturing a high-strength, high-workability steel sheet for cans. The method includes continuously casting steel containing 0.070% to less than 0.080% C, 0.003% to 0.10% Si, 0.51% to 0.60% Mn, 0.001% to 0.100% P, 0.001% to 0.020% S, 0.005% to 0.100% Al, and 0.010% or less N on a mass basis, the remainder being Fe and unavoidable impurities, into a slab; performing hot rolling; then performing coiling at a temperature of lower than 620° C.; then performing rolling at a primary cold rolling reduction of 86% or more in total such that the cold rolling reduction of a final stand for primary cold rolling is 30% or more; subsequently performing annealing in an atmosphere containing less than 0.020% by volume of an ammonia gas; and then performing secondary cold rolling at a rolling reduction of 20% or less.

Herein, % used to describe the content of each steel component refers to mass percent. The term "a depth equal to three-eighths of the thickness of a sheet" refers to the depth of a position spaced from a surface of a sheet at a distance equal to three-eighths of the thickness of the sheet in the central direction of the sheet. This applies to the terms "a depth equal to fourth-eighths of the thickness of a sheet", "a depth equal to one-eighth of the thickness of a sheet", "a depth equal to one-fourth of the thickness of a sheet", and "a depth equal to one-twentieth of the thickness of a sheet".

According to the above-described aspects of the present invention, a high-strength, high-workability steel sheet for cans having a tensile strength of 500 MPa or more and a yield elongation of 10% or more can be obtained. As a result, the enhancement in workability of steel sheets prevents cracking during the riveting of EOEs and the flanging of three-piece cans, cans can be made from DR materials with a small thickness, and steel sheet for cans can be significantly thinned.

DETAILED DESCRIPTION OF THE INVENTION

Exemplary embodiments of the present invention will now be described below in detail.

A steel sheet for cans according to an exemplary embodiment of the present invention is a high-strength, high-workability steel sheet for cans having a tensile strength of 500 MPa or more and a yield elongation of 10% or more. Such a steel sheet can be manufactured in such a manner that steel containing 0.070% to less than 0.080% C is used and the coiling temperature after hot rolling and secondary cold rolling reduction are set to appropriate conditions.

The composition of the steel sheet for cans according to this exemplary embodiment of the present invention is described below.

C: 0.070% to less than 0.080%

In the steel sheet for cans steel sheet for cans steel sheet for cans according to this exemplary embodiment of the present invention, the elongation is ensured by reducing the secondary rolling reduction and high strength is achieved by keeping the content of C high. When the C content is less than 0.070%, a tensile strength of 500 MPa, which is necessary to obtain a remarkable economic effect by reducing the thickness of the sheet, may not be achieved. Thus, the C content is 0.070% or more. On the other hand, when the C content is 0.080% or more, the steel sheet is excessively hard, and hence a thin steel sheet may not be manufactured by secondary cold rolling with the workability thereof. Thus, the upper limit of the C content is less than 0.080%.

Si: 0.003% to 0.10%

When the content of Si exceeds 0.10%, problems such as a reduction in surface treatability and a reduction in corrosion resistance are caused. Therefore, the upper limit thereof is 0.10%. However, significant refining costs are necessary to adjust the Si content to less than 0.003%. Therefore, the lower limit thereof is 0.003%.

Mn: 0.51% to 0.60%

Mn is an element which prevents hot shortness due to S during hot rolling, which has the action of refining crystal grains, and which is necessary to ensure desired material properties. In order to allow a material with reduced thickness to meet the strength of cans, the material preferably has increased strength. In order to cope with such an increase in strength, the content of Mn is preferably 0.51% or more. However, the addition of an excessively large amount of Mn causes a reduction in corrosion resistance and the excessive increase in hardness of a steel sheet. Therefore, the upper limit thereof is 0.60%.

P: 0.001% to 0.100%

P is an undesirable element which hardens steel and reduces the workability and corrosion resistance thereof. Therefore, the upper limit is 0.100%. However, in order to adjust the content of P to less than 0.001%, significant dephosphorization costs are necessary to adjust the content of P to less than 0.001%. Therefore, the lower limit thereof is 0.001%.

S: 0.001% to 0.020%

S is an undesirable element which is present in steel in the form of inclusions to cause a reduction in ductility and a reduction in corrosion resistance. Therefore, the upper limit is 0.020%. However, significant desulfurization costs are necessary to adjust the content of S to less than 0.001%. Therefore, the lower limit thereof is 0.001%.

Al: 0.005% to 0.100%

Al is a necessary element serving as a deoxidizer for steel making. When the content thereof is small, deoxidization is insufficient, the amount of inclusions is increased, and workability is reduced. When the content thereof is 0.005% or more, deoxidization can be considered to be sufficient. However, when the content thereof exceeds 0.100%, surface defects due to alumina clusters or the like are caused at an increased frequency. Therefore, the content of Al is 0.005% to 0.100%.

N: 0.010% or less

The addition of a large amount of N causes cracks in a slab during continuous casting because of the deterioration of hot ductility. Therefore, the upper limit is 0.010%. Since significant refining costs are necessary to adjust the content of N to less than 0.001%, the N content is preferably 0.001% or more.

The remainder is Fe and unavoidable impurities.

Mechanical properties of the steel sheet for cans according to this exemplary embodiment of the present invention are described below.

The tensile strength is 500 MPa or more. When the tensile strength is less than 500 MPa, the sheet may not be thinned sufficiently to obtain a remarkable economic effect for the purpose of ensuring the strength of the sheet as a material for making cans. Therefore, the tensile strength is 500 MPa or more.

The yield elongation is 10% or more. When the yield elongation is less than 10%, cracks are caused during riveting in the case of applications for EOEs. Furthermore, cracks are caused during flanging in the case of applications for three-piece can bodies. Thus, the yield elongation is 10% or more.

The tensile strength and the yield elongation can be measured by a metal material tensile test method as specified in "JIS Z 2241".

Crystal grains in the steel sheet for cans according to this exemplary embodiment of the present invention are described below.

The average size of the crystal grains is 5 μm or more in cross section in the rolling direction. The state of the crystal grains greatly affects final mechanical properties of the steel sheet for cans according to this exemplary embodiment of the present invention. When the average size of the crystal grains in cross section in the rolling direction is less than 5 μm, the sheet has insufficient elongation and reduced workability.

The elongation rate of the crystal grains is 2.0 or less in cross section in the rolling direction. The elongation rate is a value indicating the degree that ferrite crystal grains are elongated due to working as described in "JIS G 0202". When the elongation rate of the crystal grains exceeds 2.0 in cross section in the rolling direction, the elongation in a direction perpendicular to the rolling direction, which is important for flangeability and neck formability, is insufficient. The elongation rate increases with the rolling reduction of secondary cold rolling. In order to limit the elongation rate to the above value with a secondary cold rolling reduction of up to about 20%, steel preferably contains 0.070% or more C. That is, when the content of C is less than 0.070%, the number of cementite grains precipitated after hot rolling is small and consequently a large amount of solute C remains. Since solute C suppresses the growth of crystal grains during annealing, the shape of the crystal grains flattened by primary cold rolling is maintained and the elongation rate is increased.

The average size and elongation rate of the crystal grains in cross section in the rolling direction can be measured by the micrographic determination of the apparent grain size as specified in "JIS G 0551".

The front and back of the sheet are not distinguished unless otherwise specified.

The Vickers hardness can be measured by a hardness test method as specified in "JIS Z 2244". A Vickers hardness test is performed with a load of 10 gf such that the hardness distribution of a cross section in the thickness direction of the sheet can be appropriately evaluated. Ten portions for each cross section are measured for hardness and the measurements of hardness are averaged, whereby each of the average cross-sectional hardness is determined. The maximum of Vickers hardness measurements is defined as the maximum cross-sectional Vickers hardness.

Difference in hardness: ten points or more or 20 points or more

When surface layers are hardened, the strength is increased. Since a soft central layer is sandwiched between the hard surface layers, the whole of a sheet is constrained.

Therefore, the elongation of the sheet is reduced, and constriction is likely to be caused; hence, the workability is reduced. When the surface layers are soft and the central layer is hard, only the central layer of the sheet is constrained; hence, a high-strength, and high-workability steel sheet, which has high strength and in which reduction in elongation and constriction are not caused, is obtained. When the difference in average cross-sectional hardness is less than ten points and/or the maximum cross-sectional hardness is less than 20 points, the whole of a sheet has uniform hardness and therefore the sheet is not at all different from current materials; hence, any high-strength, high-workability steel sheet may not be obtained. When the difference in average cross-sectional hardness is ten points or more and/or the maximum cross-sectional hardness is 20 points or more, a tensile strength of 500 MPa or more and a yield elongation of 100 or more can be achieved.

The average N content of a portion ranging from a depth equal to three-eighths of the thickness of the sheet to a depth equal to four-eighths of the sheet thickness was determined in such a manner that a sample electropolished to a depth equal to three-eighths of the sheet thickness was measured for N content by a combustion method. The average N content of a portion ranging from a surface of the sheet to a depth equal to one-eighth of the sheet thickness was determined in such a manner that a surface of a sample was sealed with a tape, a portion ranging from a surface to a depth equal to one-eighth of the sheet thickness was chemically polished with oxalic acid, and the remaining portion of the sample was measured for N content by the combustion method.

Difference in average N content: 10 ppm or more

When the difference in average N content is less than 10 ppm, the N content in a sheet is entirely uniform and therefore softening due to a reduction in N content of a surface layer may not be expected. The sheet is not at all different from current materials and any high-strength, high-workability steel sheet may not be obtained. When the difference in average N content is 10 ppm or more, a tensile strength of 500 MPa or more and a yield elongation of 10% or more can be achieved.

The number density of nitrides was determined in such a manner that a sample was chemically polished using oxalic acid or the like to a predetermined location and was electrolyzed by 10 μm by the SPEED method. Then an extraction replica was prepared, and the number of the nitrides per 1-μm square field of view was measured using a TEM. The nitrides were analyzed by EDX and were identified.

The content of solute C was calculated from an internal friction peak.

Average nitride number density ratio: 1.5 or less

When the average nitride number density ratio is 1.5 or more, the nitride number density of a surface layer is large and therefore softening may not be expected because of the occurrence of precipitation hardening due to nitrides, which is not at all different from current materials. Therefore, any high-strength, high-workability steel sheet may not be obtained. When the average nitride number density ratio is less than 1.5, a tensile strength of 500 MPa or more and a yield elongation of 10% or more can be achieved.

A method for manufacturing the steel sheet for cans according to an exemplary embodiment of the present invention is described below.

The steel sheet for cans, which has high strength and workability, according to this exemplary embodiment of the present invention is manufactured in such a manner that a steel slab, produced by continuous casting, having the above composition is hot-rolled, is coiled at a temperature of lower than 620° C., is then rolled at a primary cold rolling reduction of 86% or more such that the cold rolling reduction of a final stand for primary cold rolling is 30% or more, is subsequently annealed in an atmosphere containing less than 0.020% by volume of an ammonia gas, and is then secondarily cold-rolled at a rolling reduction of 20% or less.

It is usually difficult to prepare a thin steel sheet capable of obtaining a remarkable economic effect by single cold rolling. That is, in order to obtain a thin steel sheet by single cold rolling, the load applied to a rolling mill is excessively large and is impossible depending on the capacity thereof. In the case of manufacturing a sheet with a final thickness of, for example, 0.15 mm, a large primary cold rolling reduction of 92.5% is necessary when the thickness of a hot-rolled sheet is 2.0 mm.

On the other hand, it can be assumed that a sheet is hot-rolled more thinly than usual for the purpose of reducing the thickness of a cold-rolled sheet, however, an increase in rolling reduction of hot rolling significantly decreases the temperature of a steel sheet in rolling and therefore a predetermined finish rolling temperature may not be obtained. Further, when the sheet thickness before annealing is small, in case of continuous annealing, there is a large possibility that troubles such as the breakage and deformation of the steel sheet arise during annealing. From these reasons, in this exemplary embodiment of the present invention, an extremely thin steel sheet is obtained by performing second cold rolling after annealing.

Coiling temperature after hot rolling: lower than 620° C.

When the coiling temperature after hot rolling is 620° C. or higher, the local elongation is low and a yield elongation of 10% or more is not achieved because a formed pearlite microstructure is coarse and can be an origin of brittle fracture. Therefore, the coiling temperature after hot rolling is lower than 620° C. and more preferably 560° C. to 620° C.

Primary cold rolling reduction: 86% or more

When the primary cold rolling reduction is small, the rolling reduction of hot rolling and the rolling reduction of secondary cold rolling are preferably increased in order to finally obtain an extremely thin steel sheet. An increase in hot rolling reduction is not preferred because of the above reason and also the secondary cold rolling reduction is preferably limited because of a reason below. From the above reasons, a primary cold rolling reduction of less than 86% leads to a difficulty in manufacture. Thus, the primary cold rolling reduction is 86% or more and more preferably 90% to 92%.

Rolling reduction of final stand for primary cold rolling: 30% or more

In order to allow surface layers of a steel sheet to contain coarse grains such that the surface layers are soft, the growth of ferrite grains is preferably promoted during annealing in such a manner that the rolling reduction of a final stand is increased and strain is induced in the surface layers of the steel sheet. In order to allow the surface layers to a grain size that is 1 μm greater than that of a central layer, the rolling reduction of the final stand for primary cold rolling is preferably 30% or more.

Annealing

During annealing, in order to prevent the nitriding of the surface layers, the concentration of an ammonia gas in an atmosphere is preferably less than 0.020% by volume. The concentration thereof is preferably 0.018% or less and more preferably 0.016% or less by volume. Recrystallization is preferably completed by annealing. In view of operation efficiency and the prevention of the breakage of a thin steel sheet during annealing, the soaking temperature is preferably 600° C. to 750° C.

Secondary cold rolling reduction: 20% or less

The secondary cold rolling reduction is 20% or less. When the secondary cold rolling reduction is more than 20%, work hardening due to secondary cold rolling is excessively large and therefore a yield elongation of 10% or more is not achieved. Thus, the secondary cold rolling reduction is 20% or less. The secondary cold rolling reduction is preferably 15% or less and more preferably 10% or less.

Steps such as a plating step are performed after secondary cold rolling in accordance with common practice, whereby the steel sheet for cans is finished.

EXAMPLES OF THE INVENTION

Steels containing components shown in Table 1, the remainder being Fe and unavoidable impurities, were each produced in an actual converter and steel slabs were obtained therefrom by a continuous casting process. After being reheated at 1250° C., the obtained steel slabs were hot-rolled and were then primarily cold-rolled under conditions shown in Table 2. The finish rolling temperature at hot rolling was 890° C. and pickling was performed subsequently to rolling. After primary cold rolling, continuous annealing was performed at a soaking temperature of 630° C. for a soaking time of 25 seconds and secondary cold rolling was then performed under conditions shown in Table 2.

Both surfaces of each of steel sheets obtained as determined above were continuously plated with Sn, whereby pieces of tinplate of which the mass per unit area of Sn was 2.8 g/m$^2$ were obtained. Test results are shown in Tables 2 and 3.

TABLE 1

| | Components (mass percent) | | | | | | | |
|---|---|---|---|---|---|---|---|---|
| No | C | Si | Mn | P | S | Al | N | Remarks |
| A | 0.069 | 0.01 | 0.51 | 0.010 | 0.010 | 0.040 | 0.0070 | Comparative steel |
| B | 0.080 | 0.01 | 0.51 | 0.010 | 0.010 | 0.040 | 0.0070 | Comparative steel |
| C | 0.070 | 0.01 | 0.50 | 0.010 | 0.010 | 0.040 | 0.0070 | Comparative steel |
| D | 0.070 | 0.01 | 0.61 | 0.010 | 0.010 | 0.040 | 0.0070 | Comparative steel |
| E | 0.070 | 0.01 | 0.51 | 0.010 | 0.010 | 0.040 | 0.011 | Comparative steel |
| F | 0.070 | 0.01 | 0.51 | 0.010 | 0.010 | 0.040 | 0.0095 | Inventive steel |

Notes:

Underlined values are outside the scope of the present invention.

TABLE 2

| No | Steel type | Coiling temperature ° C. | Plate thickness after hot rolling mm | Primary cold rolling reduction % | Rolling reduction of final stand for primary cold rolling % | Secondary cold rolling reduction % | Final plate thickness mm | Concentration of ammonia gas volume percent | Tensile strength MPa | Total elongation % | Average crystal grain size μm | Elongation rate of crystal grains |
|---|---|---|---|---|---|---|---|---|---|---|---|---|
| 1 | A | 610 | 2.6 | 90 | 30 | 18 | 0.213 | 0.018 | 495 | 11 | 5.5 | 1.80 |
| 2 | B | 610 | 2.6 | 90 | 30 | 18 | 0.213 | 0.018 | 501 | 9 | 5.7 | 1.80 |
| 3 | C | 610 | 2.6 | 90 | 30 | 18 | 0.213 | 0.018 | 496 | 11 | 5.5 | 1.80 |
| 4 | D | 610 | 2.6 | 90 | 30 | 18 | 0.213 | 0.018 | 502 | 9 | 5.7 | 1.80 |
| 5 | E | 610 | 2.6 | 90 | 30 | 18 | 0.213 | 0.018 | 505 | 9 | 5.8 | 1.80 |
| 6 | F | 610 | 2.6 | 90 | 30 | 18 | 0.213 | 0.018 | 502 | 11 | 5.9 | 1.80 |
| 7 | F | 610 | 2.6 | 90 | 30 | 18 | 0.213 | 0.018 | 502 | 11 | 5.7 | 1.80 |
| 8 | F | 610 | 2.6 | 90 | 30 | 19 | 0.211 | 0.018 | 502 | 12 | 5.7 | 1.80 |
| 9 | F | 610 | 2.6 | 90 | 30 | 18 | 0.213 | 0.018 | 502 | 12 | 5.7 | 1.80 |
| 10 | F | 610 | 2.6 | 90 | 30 | 18 | 0.213 | 0.018 | 502 | 12 | 5.7 | 1.80 |
| 11 | F | 610 | 2.6 | 90 | 30 | 18 | 0.213 | 0.018 | 502 | 12 | 5.7 | 1.80 |
| 12 | F | 610 | 2.6 | 90 | 30 | 18 | 0.213 | 0.018 | 504 | 11 | 5.7 | 1.80 |
| 13 | F | 640 | 2.6 | 90 | 30 | 18 | 0.213 | 0.018 | 490 | 13 | 6.5 | 1.80 |
| 14 | F | 610 | 2.6 | 90 | 27 | 18 | 0.213 | 0.018 | 495 | 12 | 6.2 | 1.70 |
| 15 | F | 610 | 2.6 | 90 | 30 | 21 | 0.205 | 0.018 | 503 | 9 | 4.9 | 2.10 |
| 16 | F | 610 | 2.6 | 90 | 30 | 18 | 0.213 | 0.020 | 503 | 9 | 5.9 | 1.80 |
| 17 | F | 610 | 2.6 | 90 | 30 | 18 | 0.213 | 0.021 | 503 | 8 | 6.1 | 1.80 |

TABLE 3

| | Crystal grain size | | | N content | | | Cross-sectional average Vickers hardness | | | Cross-sectional maximum Vickers hardness | | |
|---|---|---|---|---|---|---|---|---|---|---|---|---|
| No. | Layer 1* | Layer 2** μm | Layer 2 – Layer 1 | Layer 1* | Layer 2** ppm | Layer 1 – Layer 2 | Layer 1* | Layer 2** Hv | Layer 1 – Layer 2 | Layer 1* | Layer 2** Hv | Layer 1 – Layer 2 |
| 1 | 5.5 | 6.4 | 0.9 | 70 | 60 | 10 | 165 | 145 | 20 | 170 | 150 | 20 |
| 2 | 5.7 | 6.6 | 0.9 | 70 | 60 | 10 | 167 | 147 | 20 | 172 | 152 | 20 |
| 3 | 5.5 | 6.4 | 0.9 | 70 | 60 | 10 | 165 | 145 | 20 | 170 | 150 | 20 |
| 4 | 5.7 | 6.6 | 0.9 | 70 | 60 | 10 | 167 | 147 | 20 | 172 | 152 | 20 |
| 5 | 5.8 | 6.7 | 0.9 | 70 | 60 | 10 | 168 | 148 | 20 | 173 | 153 | 20 |
| 6 | 5.9 | 6.9 | 1.0 | 70 | 60 | 10 | 167 | 147 | 20 | 172 | 152 | 20 |
| 7 | 5.7 | 6.6 | 0.9 | 72 | 63 | 9 | 167 | 147 | 20 | 172 | 152 | 20 |
| 8 | 5.9 | 6.9 | 1.0 | 72 | 63 | 9 | 167 | 147 | 20 | 172 | 152 | 20 |

TABLE 3-continued

| | | | | | | | | | | | | |
|---|---|---|---|---|---|---|---|---|---|---|---|---|
| 9 | 5.7 | 6.6 | 0.9 | 72 | 62 | 10 | 168 | 147 | 21 | 173 | 152 | 21 |
| 10 | 5.7 | 6.6 | 0.9 | 72 | 63 | 9 | 169 | 147 | 22 | 172 | 152 | 20 |
| 11 | 5.8 | 6.7 | 0.9 | 72 | 63 | 9 | 167 | 147 | 20 | 172 | 152 | 20 |
| 12 | 5.7 | 6.6 | 0.9 | 72 | 63 | 9 | 167 | 147 | 20 | 172 | 152 | 20 |
| 13 | 6.5 | 7.4 | 0.9 | 70 | 60 | 10 | 163 | 144 | 19 | 168 | 149 | 19 |
| 14 | 6.0 | 6.2 | 0.2 | 70 | 60 | 10 | 165 | 160 | 5 | 175 | 172 | 3 |
| 15 | 4.8 | 5.5 | 0.7 | 70 | 60 | 10 | 168 | 149 | 19 | 173 | 154 | 19 |
| 16 | 6.0 | 6.3 | 0.3 | 70 | 60 | 10 | 168 | 160 | 8 | 174 | 166 | 8 |
| 17 | 6.0 | 6.1 | 0.1 | 70 | 60 | 10 | 168 | 190 | −22 | 178 | 198 | −20 |

| | Number density of nitrides | | | | | | | |
|---|---|---|---|---|---|---|---|---|
| No. | 1/20 surface layer*** | 1/8 surface layer*** | 1/4 surface layer**** | (1/20)/(1/4) | Solute C ppm | Compressive strength | Formability | Remarks |
| | /μm³ | | | | | | | |
| 1 | 9 | 0.1 | 11 | 0.8 | 53 | C | B | Comparative Example |
| 2 | 9 | 0.1 | 11 | 0.8 | 52 | B | C | Comparative Example |
| 3 | 9 | 0.1 | 11 | 0.8 | 51 | C | B | Comparative Example |
| 4 | 9 | 0.1 | 11 | 0.8 | 53 | B | C | Comparative Example |
| 5 | 9 | 0.1 | 11 | 0.8 | 50 | B | C | Comparative Example |
| 6 | 9 | 0.1 | 11 | 0.8 | 51 | A | A | Example |
| 7 | 20 | 6 | 5 | 4.0 | 46 | B | B | Example |
| 8 | 20 | 6 | 5 | 4.0 | 46 | B | B | Example |
| 9 | 20 | 6 | 5 | 4.0 | 46 | B | A | Example |
| 10 | 18 | 0.5 | 11 | 1.6 | 46 | B | A | Example |
| 11 | 1 | 3.0 | 2 | 0.5 | 46 | B | A | Example |
| 12 | 20 | 6 | 5 | 4.0 | 53 | A | B | Example |
| 13 | 9 | 0.1 | 11 | 0.8 | 52 | C | B | Comparative Example |
| 14 | 9 | 0.1 | 11 | 0.8 | 51 | C | B | Comparative Example |
| 15 | 9 | 0.1 | 11 | 0.8 | 53 | B | C | Comparative Example |
| 16 | 10 | 2.0 | 8 | 1.3 | 51 | B | C | Comparative Example |
| 17 | 20 | 3.0 | 5 | 4.0 | 51 | B | C | Comparative Example |

Layer 1*: From a depth equal to three-eighths of the thickness of a plate to a depth equal to four-eighths of the plate thickness.

Layer 2**: From a surface to a depth equal to one-eighth of the thickness of a plate.

1/20 surface layer***: From a surface to a depth equal to one-twentieth of the thickness of a plate.

1/8 surface layer****: From a surface to a depth equal to one-eighth of the thickness of a plate.

1/4 surface layer*****: From a surface to a depth equal to one-fourth of the thickness of a plate.

The plated steel sheets (the tinplate pieces) obtained as described above were subjected to heat treatment corresponding to paint baking at 210° C. for ten minutes and were then subjected to a tensile test. In the tensile test, tensile strength (rupture strength) and yield elongation were measured at a cross head speed of 10 mm/min using JIS No. 5 test specimens.

A sample was taken from each of the plated steel sheets and the average size and elongation rate of crystal grains therein were measured in cross section in the rolling direction. The average size and elongation rate of the crystal grains in cross section in the rolling direction were measured by a cutting method using a linear test line as specified in "JIS G 0551" in such a manner that a vertical cross section of each steel sheet was polished and grain boundaries were revealed by nital etching.

The compressive strength was measured in such a manner that each sample with a thickness of 0.21 mm was formed into a 63-mm ϕ lid, the lid was attached to a 63-mm ϕ welded can body by swaging, compressed air was introduced into a can, and the pressure at which the lid was deformed was determined. A lid that was not deformed at an internal pressure of 0.20 MPa was rated as A, a lid that was not deformed at an internal pressure of up to 0.19 MPa but was deformed at an internal pressure of 0.20 MPa was rated as B, and a lid that was deformed at an internal pressure of 0.19 MPa or less was rated as C.

The formability was tested by a method specified in JIS Z 2247 using a testing machine specified in JIS B 7729.

An Erichsen value (a forming height at which penetration cracking occurs) of 6.5 mm or more was rated as A, an Erichsen value of 6.0 mm to less than 6.5 mm was rated as B, and an Erichsen value of less than 6.0 mm was rated as C.

As is clear from Tables 1 to 3, Nos. 6 to 12, which are examples of the present invention, are excellent in strength and have a tensile strength of 500 MPa or more, which is necessary for extremely thin steel sheet for cans. Furthermore, Nos. 6 to 12 are excellent in workability and have an elongation of 10% or more, which is necessary to work lids and three-piece can bodies.

In contrast, No. 1, which is a comparative example, has an too small C content and therefore is insufficient in tensile strength. No. 2, which is a comparative example, has an excessively large C content and therefore is insufficient in yield elongation as the ductility is deteriorated due to secondary cold rolling. No. 3, which is a comparative example, has an too small Mn content and therefore is insufficient in tensile strength. No. 4, which is a comparative example, has an excessively large Mn content and therefore is insufficient in yield elongation as the ductility is deteriorated due to secondary cold rolling. No. 5, which is a comparative example, has an excessively large N content and therefore is insufficient in yield elongation as the ductility is deteriorated due to secondary cold rolling.

Since the coiling temperature of No. 13, which is a comparative example, is excessively high, crystal grains therein are coarsened and the strength thereof is insufficient. No. 14, which is a comparative example, has a large average crystal grain size and a large average crystal grain size of a central layer thereof, and is insufficient in strength because the secondary cold rolling reduction of a final stand is too small. No. 15, which is a comparative example, has an excessively large secondary cold rolling reduction and therefore is insufficient in yield elongation as the ductility is deteriorated due to secondary cold rolling. Nos. 16 and 17, which are comparative examples, have reduced ductility and insufficient yield elongation because the concentrations of ammonia gas in annealing atmospheres used are excessively high and therefore surface layers thereof were hardened.

The invention claimed is:

1. A high-strength, high-workability steel sheet for cans containing 0.070% to less than 0.080% C, 0.003% to 0.10% Si, 0.51% to 0.60% Mn, 0.001% to 0.100% P, 0.001% to 0.020%, 0.005% to 0.100% Al, and 0.010% or less N on a mass basis, the remainder being Fe and unavoidable impurities, the sheet having a tensile strength of 500 MPa or more and a yield elongation of 10% or more, wherein the average size and elongation rate of crystal grains are 5 μm or more and 2.0 or less, respectively, in cross section in the rolling direction thereof; the hardness difference obtained by subtracting the average Vickers hardness of a cross section ranging from a surface to a depth equal to one-eighth of the thickness of the sheet from the average Vickers hardness of a cross section ranging from a depth equal to three-eighths of the sheet thickness to a depth equal to four-eighths of the sheet thickness is 10 points or more; and/or the hardness difference obtained by subtracting the maximum Vickers hardness of the cross section ranging from the surface to a depth equal to one-eighth of the sheet thickness from the maximum Vickers hardness of the cross section ranging from a depth equal to three-eighths of the sheet thickness to a depth equal to four-eighths of the sheet thickness is 20 points or more.

2. The high-strength, high-workability steel sheet for cans according to claim 1, wherein in relation to the crystal grain size, the average crystal grain size difference obtained by subtracting the average size of crystal grains present between a depth equal to three-eighths of the sheet thickness to a depth equal to four-eighths of the sheet thickness from the average size of crystal grains present between the surface and a depth equal to one-eighth of the sheet thickness is 1 μm or more.

3. The high-strength, high-workability steel sheet for cans according to claim 1, wherein in relation to the content of nitrogen, the average N content difference obtained by subtracting the average N content between the surface and a depth equal to one-eighth of the sheet thickness from the average N content between a depth equal to three-eighths of the sheet thickness to a depth equal to four-eighths of the sheet thickness is 10 ppm or more.

4. The high-strength, high-workability steel sheet for cans according to claim 1, wherein in relation to nitrides with a diameter of 0.02 μm to 1 μm, the average number density of the nitrides present between the surface and a depth equal to one-fourth of the sheet thickness is greater than the average number density of the nitrides present between the surface and a depth equal to one-eighth of the sheet thickness.

5. The high-strength, high-workability steel sheet for cans according to claim 1, wherein in relation to the nitrides with a diameter of 0.02 μm to 1 μm, the quotient obtained by dividing the average number density of the nitrides present between the surface and a depth equal to one-twentieth of the sheet thickness by the average number density of the nitrides present between the surface and a depth equal to one-fourth of the sheet thickness is less than 1.5.

6. The high-strength, high-workability steel sheet for cans according to claim 1, wherein in relation to the content of carbon, a content of solute C in steel is 51 ppm or more.

7. A method for manufacturing a high-strength, high-workability steel sheet fro cans, comprising continuously casting steel containing 0.070% to less than 0.080% C, 0.003% to 0.10% Si, 0.51% to 0.60% Mn, 0.001% to 0.100% P, 0.001% to 0.020% S, 0.005% to 0.100% Al, and 0.010% or less N on a mass basis, the remainder being Fe and unavoidable impurities, into a slab; performing hot rolling; then performing coiling at a temperature of lower than 620° C.; then performing rolling at a primary cold rolling reduction of 86% or more in total such that the cold rolling reduction of a final stand for primary cold rolling is 30% or more; subsequently performing annealing in an atmosphere containing less than 0.020% by volume of an ammonia gas; and then performing secondary cold rolling at a rolling reduction of 20% or less.

* * * * *

UNITED STATES PATENT AND TRADEMARK OFFICE

CERTIFICATE OF CORRECTION

PATENT NO. : 8,557,065 B2
APPLICATION NO. : 13/513113
DATED : October 15, 2013
INVENTOR(S) : Masaki Tada et al.

It is certified that error appears in the above-identified patent and that said Letters Patent is hereby corrected as shown below:

In the Specification

In column 5, line 5 the line beginning with "In the steel sheet for cans steel sheet for cans steel sheet for cans" should read --In the steel sheet for cans--.

In column 9 and 10, the heading of column 4 of Table 2 which reads "Plate thickness after hot rolling mm" should read --Sheet thickness after hot rolling mm--.

The footnotes of Table 3 beginning with "Layer 1*" should read:

--Layer 1*: From a depth equal to three-eighths of the thickness of a sheet to a depth equal to four-eighths of the sheet thickness.

Layer 2**: From a surface to a depth equal to one-eighth of the thickness of a sheet.

1/20 surface layer***: From a surface to a depth equal to one-twentieth of the thickness of a sheet.

1/8 surface layer****: From a surface to a depth equal to one-eighth of the thickness of a sheet.

1/4 surface layer*****: From a surface to a depth equal to one-fourth of the thickness of a sheet.--.

In the Claims

In Claim 7 at column 14, line 26 the preamble beginning "A method for manufacturing a high-strength, high-workability steel sheet fro cans" should read --A method for manufacturing a high-strength, high-workability steel sheet for cans--.

Signed and Sealed this
Twenty-ninth Day of April, 2014

Michelle K. Lee

Michelle K. Lee
*Deputy Director of the United States Patent and Trademark Office*